US007010822B1

(12) United States Patent
Lin

(10) Patent No.: US 7,010,822 B1
(45) Date of Patent: Mar. 14, 2006

(54) CONNECTING DEVICE FOR CONNECTING A MAIN TOOL AND AN AUXILIARY TOOL OF A COMBINATION TOOL

(76) Inventor: Ming-Shuan Lin, No. 29-2, Sec. 1, Tafeng Rd., Tantzu Hsiang, Taichung Hsien (TW)

( * ) Notice: Subject to any disclaimer, the term of this patent is extended or adjusted under 35 U.S.C. 154(b) by 0 days.

(21) Appl. No.: 11/002,344

(22) Filed: Dec. 1, 2004

(51) Int. Cl.
*B25F 1/00* (2006.01)

(52) U.S. Cl. ..... 7/143; 7/145; 7/158

(58) Field of Classification Search ..... 7/143–145, 7/158, 159, 128; 81/20, 21, 25, 26, 180.1
See application file for complete search history.

(56) References Cited

U.S. PATENT DOCUMENTS 1,501,585 A * 7/1924 Cullen ..... 81/98
2,406,116 A * 8/1946 Slyke ..... 7/145
2,932,537 A * 4/1960 Wolfe ..... 294/51
3,561,023 A * 2/1971 Shandel ..... 7/116
3,824,641 A * 7/1974 Shandel ..... 7/116
4,183,385 A * 1/1980 Burkybile ..... 81/25
4,287,623 A * 9/1981 Tarran ..... 7/158
4,741,059 A * 5/1988 Lee et al. ..... 7/127
5,297,306 A * 3/1994 Shandel ..... 7/114
5,507,051 A * 4/1996 Mazon ..... 7/116
5,564,852 A * 10/1996 Maxwell et al. ..... 403/97
6,192,539 B1 * 2/2001 Fraga et al. ..... 7/144
6,339,858 B1 * 1/2002 Fraga et al. ..... 7/144
6,601,254 B1 * 8/2003 Walz ..... 7/128
6,739,010 B1 * 5/2004 Lin ..... 7/143

* cited by examiner

*Primary Examiner*—David B. Thomas
(74) *Attorney, Agent, or Firm*—David N. Lathrop, Esq.; Gallagher & Lathrop

(57) ABSTRACT

A connecting device, which connects detachably a main tool and an auxiliary tool of a combination tool, includes first and second clamping members, a pivot joint, and a fastening member. The pivot joint interconnects the first and second clamping members, and permits relative rotation of the first and second clamping members to a clamping position, where the first and second clamping members embrace the main tool. The fastening member serves to fasten releasably the first and second clamping members to the main tool when the first and second clamping members are rotated relative to each other to the clamping position.

5 Claims, 6 Drawing Sheets

CONNECTING DEVICE FOR CONNECTING A MAIN TOOL AND AN AUXILIARY TOOL OF A COMBINATION TOOL

BACKGROUND OF THE INVENTION

1. Field of the Invention

The invention relates to a connecting device, more particularly to a connecting device for connecting detachably a main tool and an auxiliary tool of a combination tool.

2. Description of the Related Art

A conventional combination tool is disclosed in U.S. Pat. No. 6,739,010. The conventional combination tool includes a hammer, an auxiliary tool, and a connecting device. The hammer includes ahead, a handle that extends from the head, and a neck between the head and the handle. The head has top and bottom sides, and includes a claw that is formed on the top side of the head, and a hammerhead that is formed on the bottom side of the head. The auxiliary tool is connected detachably to the head of the hammer. The connecting device serves to connect detachably the auxiliary tool to the hammer. In particular, the connecting device includes a socket, a pair of opposite retaining walls, and a clamping part. The socket is connected to the auxiliary tool and receives the hammerhead of the hammer. The retaining walls extend from the socket, and retain the neck of the hammer therebetween. Each of the retaining walls has a distal end distal to the socket. The clamping part includes a transverse wall that interconnects the distal ends of the retaining walls, a press block that is disposed movably between the retaining walls, and a locking screw that extends through and that threadedly engages the transverse wall, and that is coupled to the press block. The locking screw is operable so as to press selectively the press block against the neck of the hammer, thereby connecting detachably the auxiliary tool to the head of the hammer.

The aforementioned conventional combination tool is disadvantageous in that, since the neck of the hammer has to be disposed between the retaining walls of the connecting device, the operation for connecting the auxiliary tool to the head of the hammer via the connecting device is troublesome.

SUMMARY OF THE INVENTION

Therefore, the main object of the present invention is to provide an easy-to-operate connecting device so as to overcome the aforesaid drawback of the prior art.

According to the present invention, a connecting device includes first and second clamping parts, a pivot joint, and a fastening member. The connecting device serves to connect detachably a main tool and an auxiliary tool of a combination tool. The main tool includes a head, and a handle that extends from the head. The head of the main tool has a front end, left and right sides, and top and bottom sides, and is formed with a through-hole that extends through the left and right sides. Each of the first and second clamping members is formed with a hole therethrough and is provided with a pair of tabs. The hole in the second clamping member is defined by a groove-defining wall that is formed with an inner thread. The pivot joint interconnects the first and second clamping members, and permits relative rotation of the first and second clamping members to a clamping position, where the first and second clamping members embrace the left and right sides of the head of the main tool, where the tabs of each of the first and second clamping members embrace the top and bottom sides of the head of the main tool, and where the holes in the first and second clamping members align with the through-hole in the head of the main tool. The fastening member serves to fasten releasably the first and second clamping members to the head of the main tool when the first and second clamping members are rotated relative to each other to the clamping position. The fastening member includes a screw fastener that extends through the hole in the first clamping member and the through-hole in the head of the main tool, and that threadedly engages the inner thread of the groove-defining wall of the second clamping member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
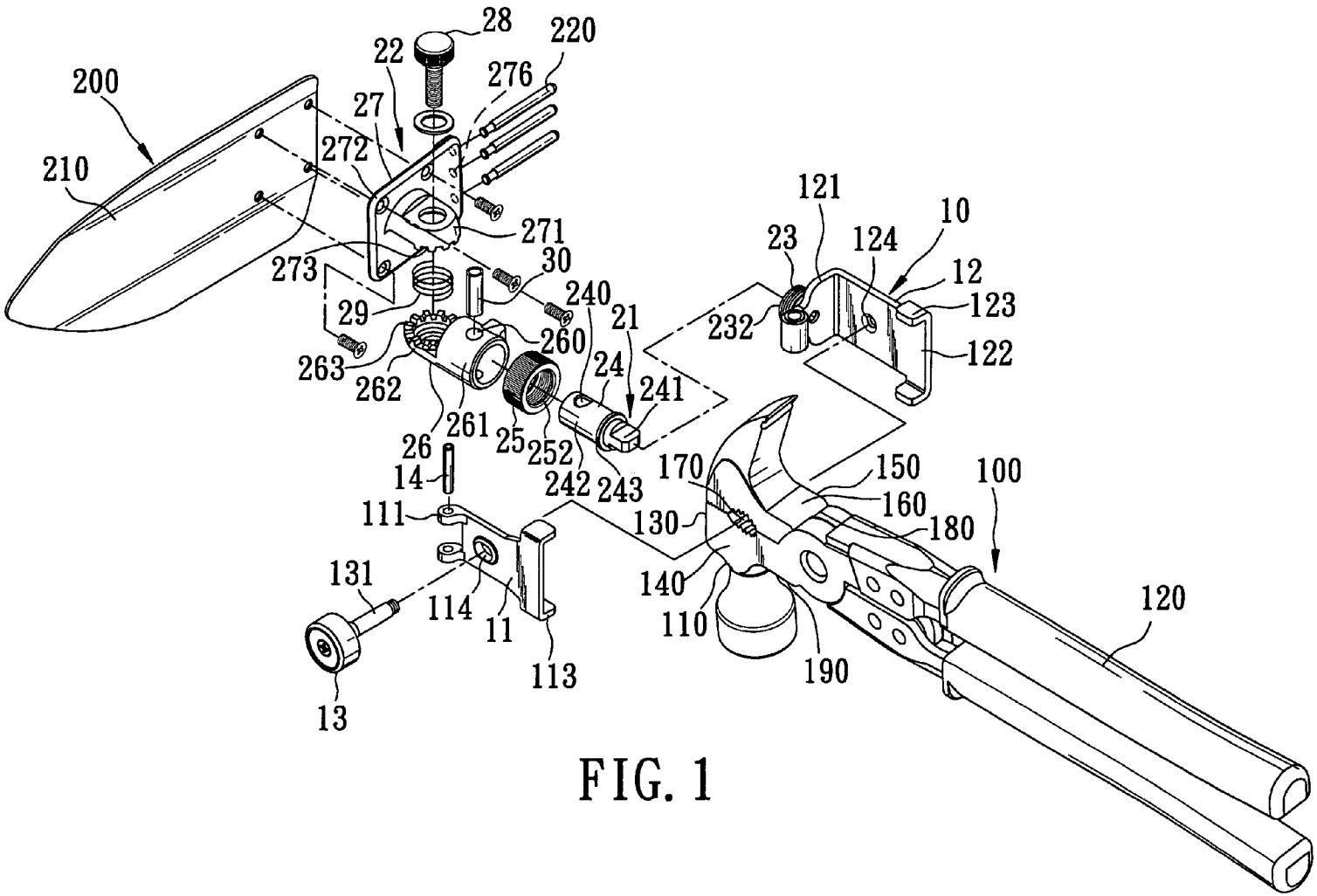
FIG. 1 is an exploded perspective view of the preferred embodiment of a connecting device according to the present invention.
Figure 2:
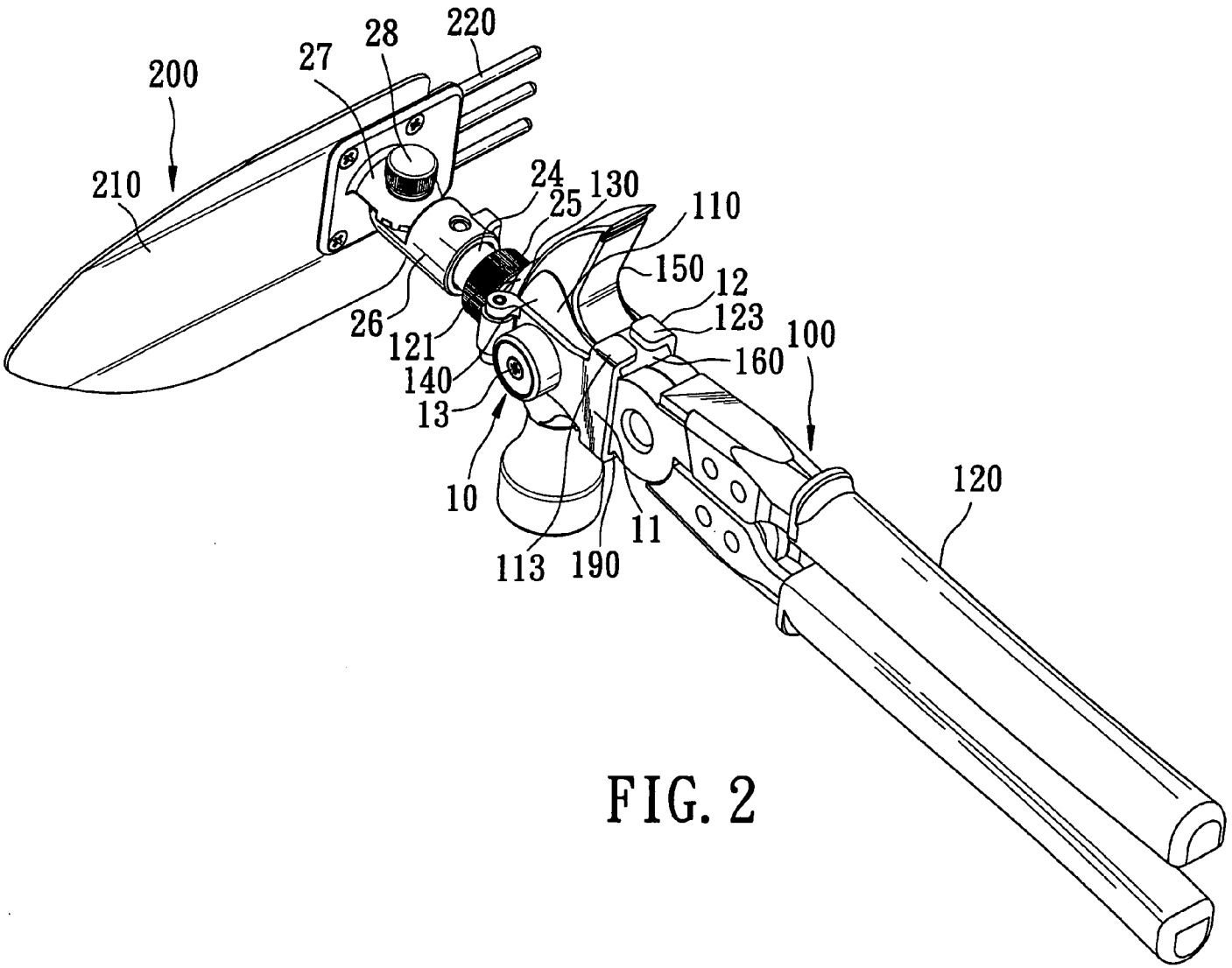
FIG. 2 is perspective view of the preferred embodiment in a state of use.

Referring to FIGS. 1 and 2, the preferred embodiment of a connecting device 10 according to this invention is shown to include first and second clamping members 11, 12, a pivot joint 14, and a fastening member 13.

The connecting device 10 serves to connect detachably a main tool 100 and an auxiliary tool 200 of a combination tool, in a manner that will be described hereinafter.

The main tool 100 includes a head 110, and a handle 120 that extends from the head 110. The head 110 of the main tool 100 has front and rear ends 130, 180, left and right sides 140, 150, and top and bottom sides 160, 190. Each of the top and bottom sides 160, 190 of the head 110 has front and rear end portions. Moreover, the head 110 of the main tool 100 is formed with a through-hole 170 that extends through the left and right sides 140, 150.

In this embodiment, the main tool 100 is a combination of a hammer and a pair of pliers. In particular, the head 110 of the main tool 100 includes a claw that is formed on the front end portion of the top side 160 of the head 110, and a hammerhead that is formed on the front end portion of the bottom side 190 of the head 110. Moreover, the head 110 of the main tool 100 includes a pair of toothed jaws, which cooperatively define the through-hole 170 therebetween. The handle 120 includes a first handle part that extends from one of the jaws, and a second handle part that is connected pivotally to the first handle part and that extends from the other one of the jaws.

In this embodiment, the auxiliary tool 200 includes a shovel blade 210 and rake teeth 220.

The pivot joint 14 interconnects the first and second clamping members 11, 12. In this embodiment, the pivot joint 14 permits relative rotation of the first and second clamping members 11, 12 to a clamping position, where the first and second clamping members 11, 12 embrace the left and right sides 140, 150 of the head 110 of the main tool 100. In particular, the second clamping member 12 is generally L-shaped, and includes shorter and longer arms 121, 122. The shorter arm 121 has a distal end distal to the longer arm 122. The pivot joint 14 interconnects the distal end of the shorter arm 121 of the second clamping member 12 and the first clamping member 11. As best shown in FIG. 2, when the first and second clamping members 11, 12 are rotated relative to each other to the clamping position, the first clamping member 11 abuts against the left side 140 of the head 110 of the main tool 100, and the shorter and longer arms 121, 122 of the second clamping member 12 respectively abut against the front end 130 and the right side 150 of the head 110 of the main tool 100. Moreover, each of the first and second clamping members 11, 12 is formed with a pair of tabs 113, 123. The tabs 113, 123 of each of the first and second clamping members 11, 12 embrace the rear end portions of the top and bottom sides 160, 190 of the head 110 of the main tool 100 when the first and second clamping members 11, 12 are rotated relative to each other to the clamping position.

The fastening member 13 is operable so as to fasten releasably the first and second clamping members 11, 12 to the head 110 of the main tool 100 when the first and second clamping members 11, 12 are rotated relative to each other to the clamping position. In particular, each of the first and second clamping members 11, 12 is formed with a hole 114, 124 therethrough. The holes 114, 124 in the first and second clamping members 11, 12 are aligned with the through-hole 170 in the head 110 of the main tool 110 when the first and second clamping members 11, 12 are rotated relative to each other to the clamping position. Moreover, the hole 124 in the second clamping member 12 is defined by a groove-defining wall that is formed with an inner thread. The fastening member 13 includes a screw fastener 131 that extends through the hole 114 in the first clamping member 11 and the through-hole 170 in the head 110, and that threadedly engages the inner thread of the groove-defining wall of the second clamping member 12, thereby connecting detachably the auxiliary tool 200 to the head 110 of the main tool 100.

Figure 3:
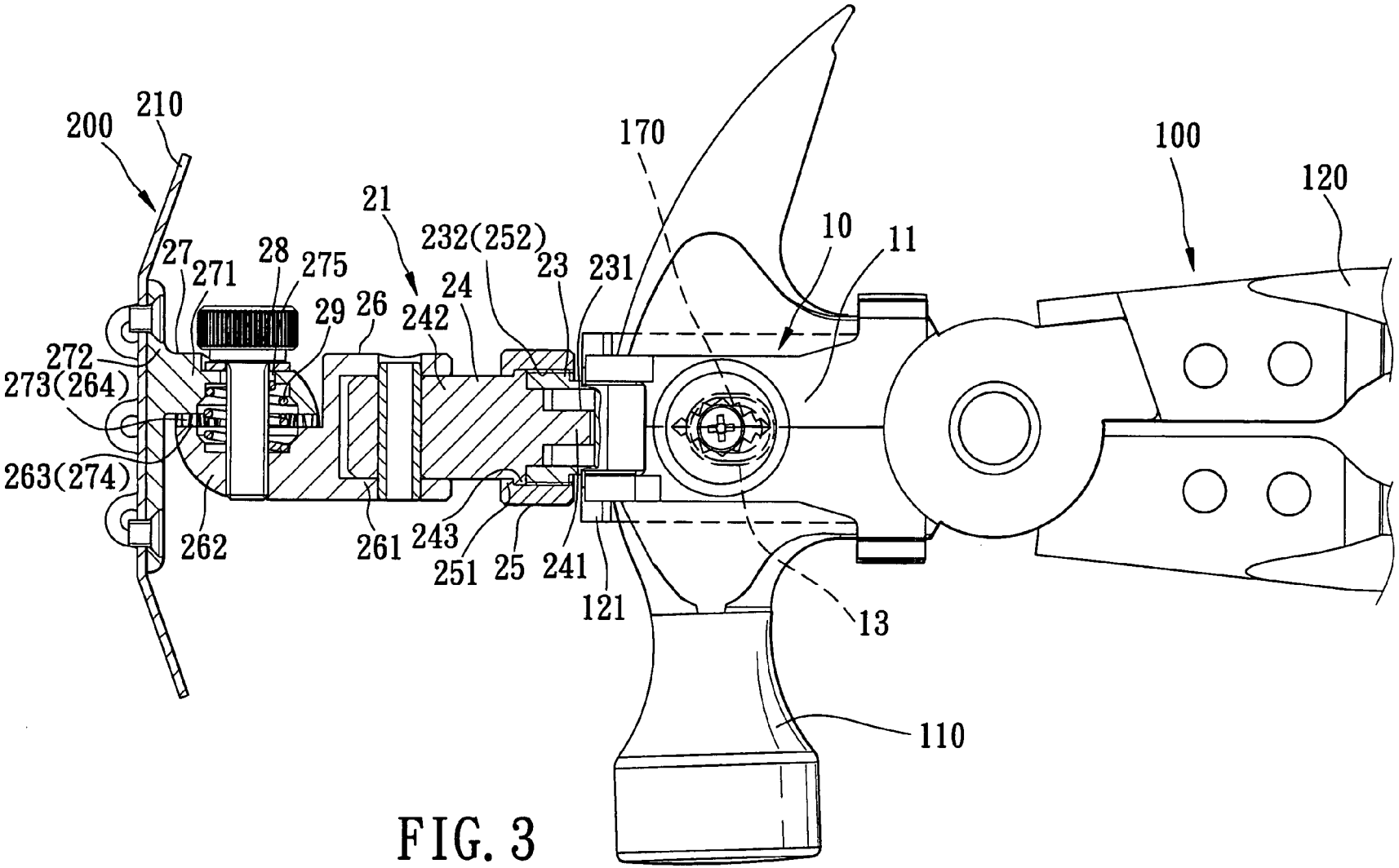
FIG. 3 is a fragmentary sectional view of the preferred embodiment illustrating an adjusting unit.
Figure 4:
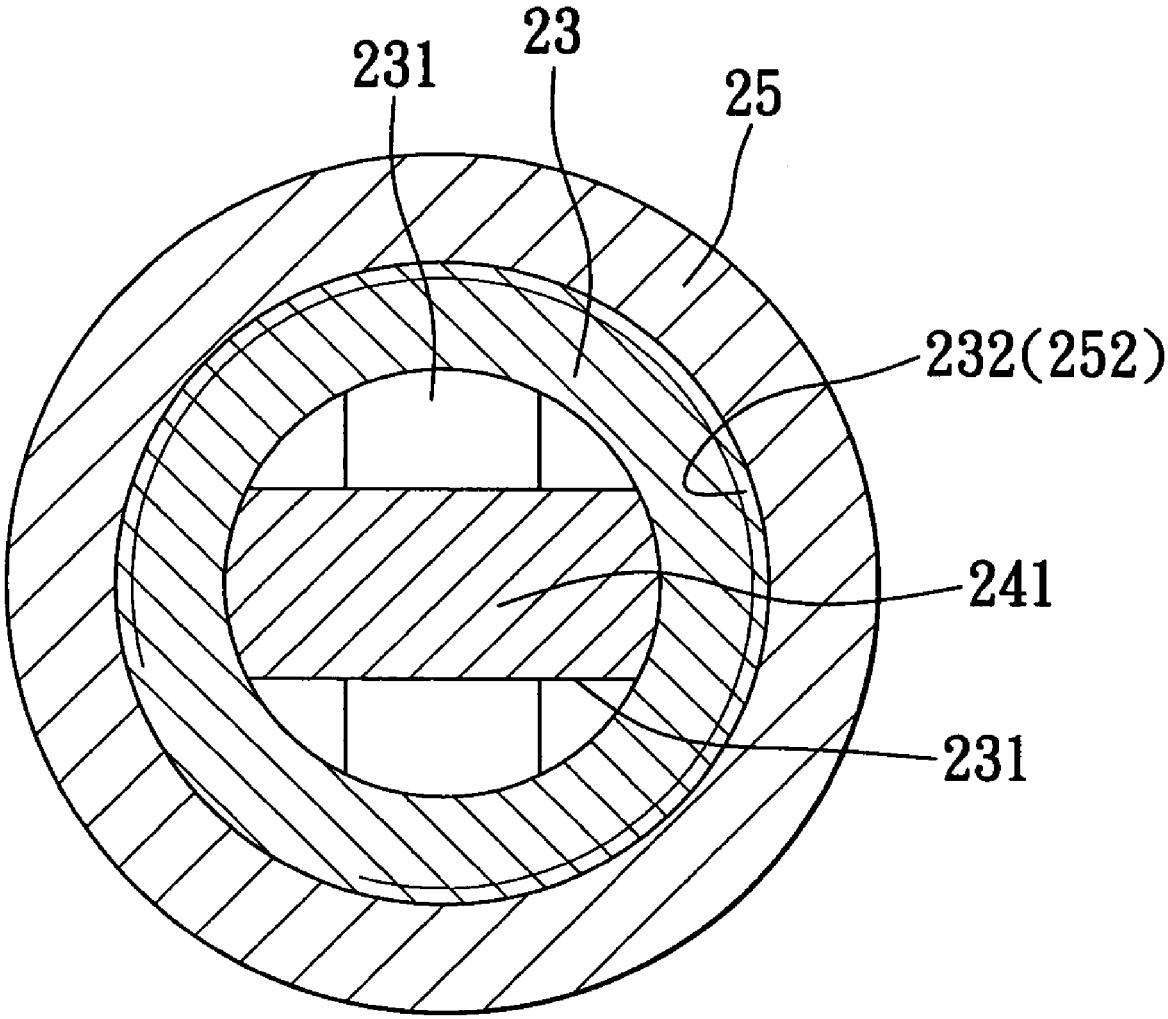
FIG. 4 is a sectional view of the preferred embodiment illustrating a cross-section of a cylindrical coupling body of the adjusting unit.

With further reference to FIGS. 3 and 4, the connecting device 10 further includes an adjusting unit 21 that permits adjustment of the orientation of the auxiliary tool 200 relative to the main tool 100. In particular, the adjusting unit 21 includes a cylindrical coupling body 23, an engaging piece 24, and a cap 25. The coupling body 23 is formed on the shorter arm 121 of the second clamping member 12, defines an engaging groove therein, and has an outer surface 232 that is formed with an outer thread. As best shown in FIG. 4, the engaging groove in the coupling body 23 has a non-circular cross-section, preferably a cross-shaped, and includes a pair of crossed groove sections 231.

The engaging piece 24 has a first end portion 242 that has a circular cross-section, and a second end portion 241 that has a cross-section, which corresponds to that of the groove sections 231 of the engaging groove in the coupling body 23, and that is formed with a flange 243. The flange 243 of the engaging piece 24 abuts against the coupling body 23 when the second end portion 241 of the engaging piece 24 is inserted into one of the groove sections 231 of the engaging groove in the coupling body 23.

The cap 25 is sleeved on the second end portion 241 of the engaging piece 24, has an inner surface 252 formed with an inner thread, which threadedly engages the outer thread 232 of the coupling body 23, and abuts against the flange 243 of the engaging piece 24 so as to retain the second end portion 241 of the engaging piece 24 in one of the groove sections 231 of the engaging groove in the coupling body 23.

When it is desired to reorient the auxiliary tool 200 relative to the main tool 100, the cap 25 is first disengaged from the coupling body 23. At this time, the second end portion 241 of the engaging piece 24 may be removed and re-inserted into the other one of the groove sections 231 of the engaging groove in the coupling body 23. Thereafter, the cap 25 is threadedly engaged to the coupling body 23 so as to retain the second end portion 241 of the engaging piece 24 in the other one of the groove sections 231 of the engaging groove in the coupling body 23.

Figure 5:
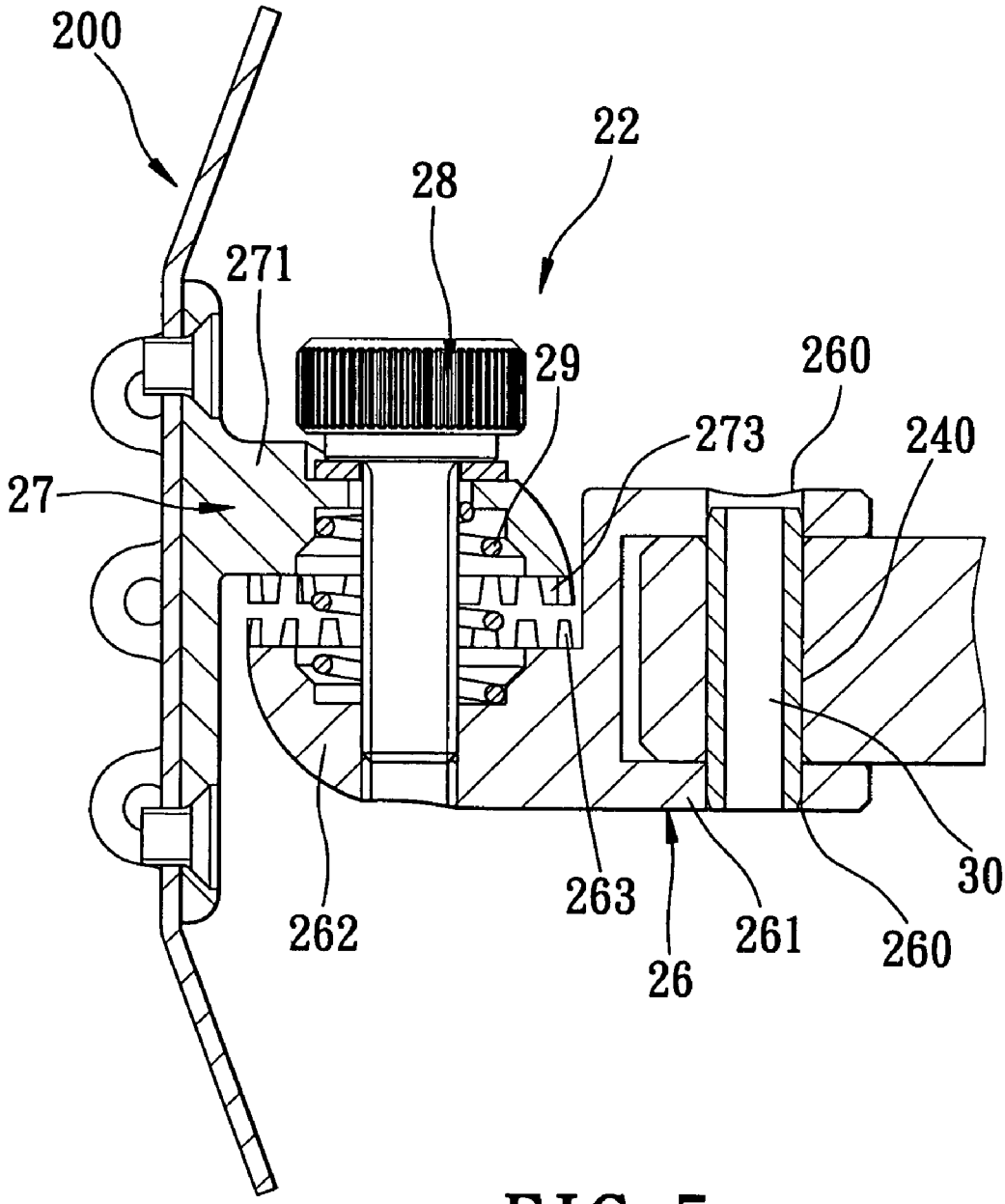
FIG. 5 is a fragmentary sectional view of the preferred embodiment illustrating a swiveling unit.
Figure 6:
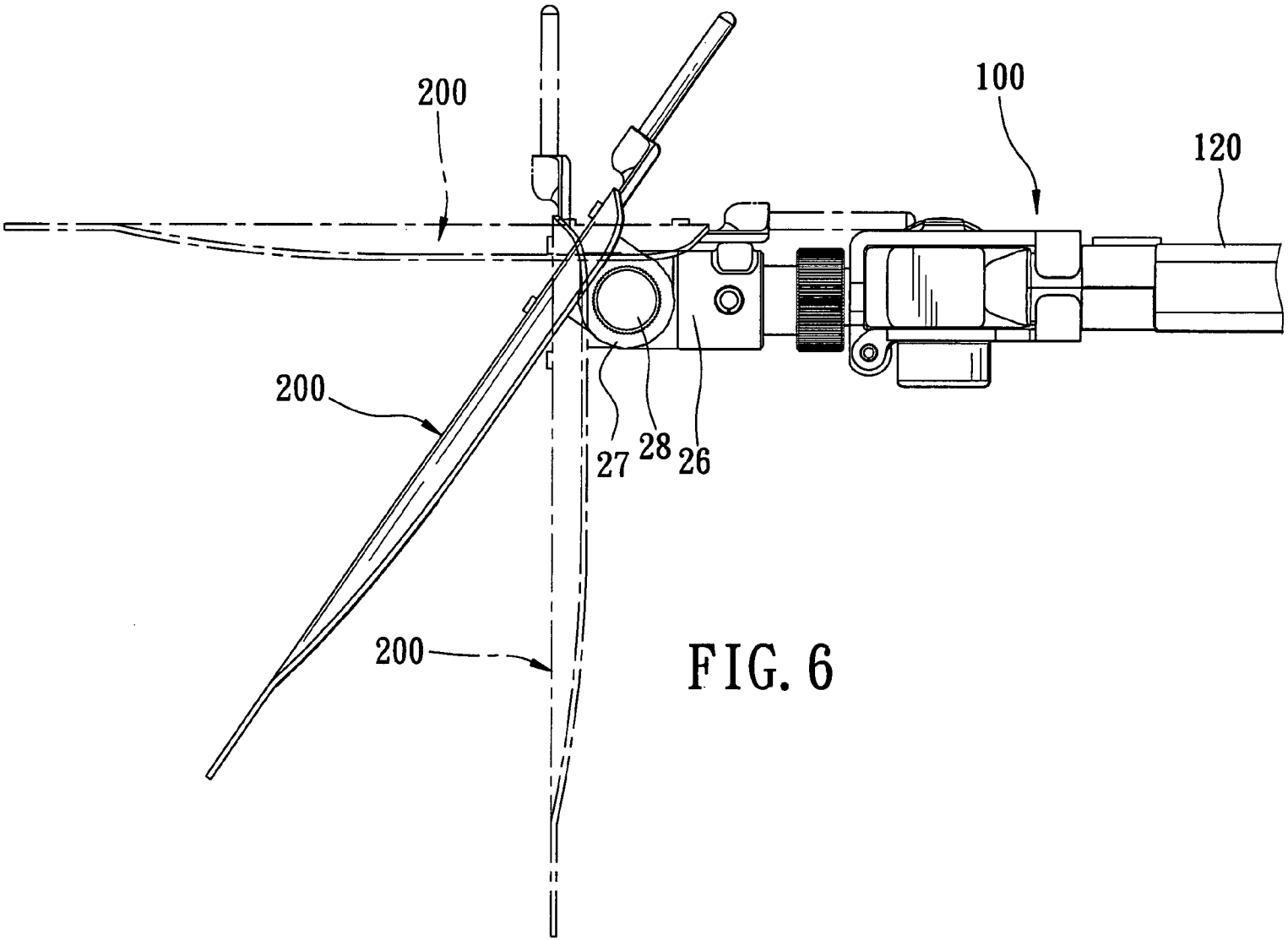
FIG. 6 is a fragmentary schematic view of the preferred embodiment illustrating operation of the swiveling unit.

With further reference to FIGS. 5 and 6, the connecting device 10 further includes a swiveling unit 22 that permits adjustment of the orientation of the auxiliary tool 200 relative to the main tool 100. In particular, the swiveling unit 22 includes first and second swiveling members 26, 27, and a pivot bolt 28.

As best shown in FIG. 1, the first swiveling member 26 has a first end portion 262 that is formed with a first bore, and ratchet teeth 263 that surround the first bore, and a tubular second end portion 261. It is noted that the first bore in the first end portion 262 of the first swiveling member 26 is defined by a bore-defining wall that is formed with an inner thread.

As best shown in FIG. 3, the second end portion 261 of the first swiveling member 26 is sleeved on the first end portion 242 of the engaging piece 24 of the adjusting unit 21.

The first end portion 242 of the engaging piece 24 of the adjusting unit 21 is formed with an engaging hole 240 therethrough (see FIG. 1). The second end portion 261 of the first swiveling member 26 is formed with a pair of engaging holes 260 (see FIG. 1). A pin 30 extends through one of the engaging holes 260 in the second end portion 261 of the first swiveling member 26, the engaging hole 240 in the first end portion 242 of the engaging piece 24, and the other one of the engaging holes 260 in the second end portion 261 of the first swiveling member 26.

The second swiveling member 27 has a first end portion 272 coupled to the auxiliary tool 200, and a second end portion 271 formed with a second bore, and ratchet teeth 273 that surround the second bore in the second end portion 271 of the second swiveling member 27.

As best shown in FIG. 5, the pivot bolt 28 extends through the second bore in the second end portion 271 of the second swiveling member 27 and threadedly engages the inner thread of the bore-defining wall of the first end portion 262 of the first swiveling member 26. In this embodiment, the pivot bolt 28 is operable so as to permit relative movement of the first and second swiveling members 26, 27 between an engaging position, where the ratchet teeth 263 of the first swiveling member 26 engage the ratchet teeth 273 of the second swiveling member 27, and a disengaging position, where the ratchet teeth 263 of the first swiveling member 26 disengage from the ratchet teeth 273 of the second swiveling member 27.

The swiveling unit 22 further includes a biasing spring 29 that is sleeved on the pivot bolt 28, that is disposed between the first end portion 262 of the first swiveling member 26 and the second end portion 271 of the second swiveling member 27, and that urges the first and second swiveling members 26, 27 to the disengaging position. The biasing spring 29 has opposite ends received respectively in the first bore in the first end portion 262 of the first swiveling member 26 and in the second bore of the second end portion 271 of the second swiveling member 27.

As illustrated in FIG. 6, when it is desired to reorient the auxiliary tool 200 relative to the main tool 100, the pivot bolt 28 is first operated so as to dispose the first and second swiveling members 26, 27 at the disengaging position. At this time, the auxiliary tool 200 may be adjusted to form a desired angle with respect to the main tool 100. Thereafter, the pivot bolt 28 is operated so as to dispose the first and second swiveling members 26, 27 at the engaging position, thereby retaining the auxiliary tool 200 at the desired angle relative to the main tool 100.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A connecting device adapted for connecting detachably a main tool and an auxiliary tool of a combination tool, the main tool including a head, and a handle that extends from the head, the head of the main tool having a front end, left and right sides, and top and bottom sides, and being formed with a through-hole that extends through the left and right sides, said connecting device comprising:

first and second clamping members, each of which is formed with a hole therethrough and is provided with a pair of tabs, said hole in said second clamping member being defined by a groove-defining wall that is formed with an inner thread, a pivot joint interconnecting said first and second clamping members, said pivot joint permitting relative rotation of said first and second clamping members to a clamping position, where said first and second clamping members embrace the left and right sides of the head of the main tool, where said tabs of each of said first and second clamping members embrace the top and bottom sides of the head of the main tool, and where said holes in said first and second clamping members align with said through-hole in the head of the main tool; and a fastening member for fastening releasably said first and second clamping members to the head of the main tool when said first and second clamping members are rotated relative to each other to the clamping position, said fastening member including a screw fastener that extends through said hole in said first clamping member and said through-hole in the head of the main tool, and that threadedly engages said inner thread of said groove-defining wall of said second clamping member.

2. The connecting device as claimed in claim 1, wherein said second clamping member is generally L-shaped, and includes shorter and longer arms, said pivot joint interconnecting said shorter arm of said second clamping member and said first clamping member, said first clamping member abutting against the left side of the head of the main tool, and said shorter and longer arms of said second clamping member respectively abutting against said front end and right side of the head of the main tool when said first and second clamping members are rotated relative to each other to the clamping position.

3. The connecting device as claimed in claim 1, further comprising an adjusting unit for permitting adjustment of the orientation of the auxiliary tool relative to the main tool, said adjusting unit including a cylindrical coupling body that is formed on said second clamping member, that defines an engaging groove therein, and that has an outer surface, said engaging groove of said coupling body having a non-circular cross-section, said outer surface of said coupling body being formed with an outer thread, an engaging piece that has a first end portion, which is coupled to the auxiliary tool, and a second end portion, which has a cross-section that corresponds to that of said engaging groove in the coupling body and which is formed with a flange, said flange of said engaging piece abutting against said coupling body when said second end portion of said engaging piece is inserted into said engaging groove in said coupling body, and a cap that is sleeved on said second end portion of said engaging piece, that has an inner surface formed with an inner thread for threadedly engaging said outer thread of said coupling body, and that abuts against said flange of said engaging piece so as to retain said second end portion of said engaging piece in said engaging groove in said coupling body.

4. The connecting device as claimed in claim 3, further comprising a swiveling unit for permitting adjustment of the orientation of the auxiliary tool relative to the main tool, said swiveling unit including a first swiveling member that has opposite first and second end portions, said first end portion of said first swiveling member being formed with a first bore, and ratchet teeth that surround said first bore, said second end portion of said first swiveling member being coupled to said first end portion of said engaging piece of said adjusting unit, said first bore in said first end portion of said first swiveling member being defined by a bore-defining wall that is formed with an inner thread, a second swiveling member that has opposite first and second end portions, said first end portion of said second swiveling member being coupled to the auxiliary tool, said second end portion of said second swiveling member being formed with a second bore, and ratchet teeth that surround said second bore, and a pivot bolt that extends through said second bore in said second end portion of said second swiveling member, and that threadedly engages said inner thread of said bore-defining wall of said first end portion of said first swiveling member, said pivot bolt being operable so as to permit relative movement of said first and second swiveling members between an engaging position, where said ratchet teeth of said first swiveling member engage said ratchet teeth of said second swiveling member, and a disengaging position, where said ratchet teeth of said first swiveling member disengage from said ratchet teeth of said second swiveling member.

5. The connecting device as claimed in claim 4, wherein said swiveling unit further includes a biasing spring that is sleeved on said pivot bolt of said swiveling unit, that is disposed between said first end portion of said first swiveling member and said second end portion of said second swiveling member, and that urges said first and second swiveling members to the disengaging position.

* * * * *